US007333755B2

(12) United States Patent
Koido

(10) Patent No.: US 7,333,755 B2
(45) Date of Patent: Feb. 19, 2008

(54) DEVELOPING DEVICE HAVING DEVELOPER SUPPLY UNIT AND IMAGE FORMING APPARATUS

(75) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 299 days.

(21) Appl. No.: 11/191,047

(22) Filed: Jul. 28, 2005

(65) Prior Publication Data

US 2006/0024090 A1 Feb. 2, 2006

(30) Foreign Application Priority Data

Aug. 2, 2004 (JP) ..... 2004-225469

(51) Int. Cl.
*G03G 15/08* (2006.01)

(52) U.S. Cl. ..... 399/254; 399/256

(58) Field of Classification Search ..... 399/254–256, 399/258, 281

See application file for complete search history.

(56) References Cited

U.S. PATENT DOCUMENTS 5,867,756 A * 2/1999 Suzuki et al. ..... 399/255
6,047,152 A * 4/2000 Hattori et al. ..... 399/256
6,122,472 A * 9/2000 Sako et al. ..... 399/254
6,985,685 B2 * 1/2006 Shigeta et al. ..... 399/254

FOREIGN PATENT DOCUMENTS

JP 2002-108089 4/2002

* cited by examiner

*Primary Examiner*—William J. Royer
(74) *Attorney, Agent, or Firm*—Takeuchi & Kubotera, LLP

(57) ABSTRACT

A developing device includes a developing unit for attaching developer to a latent image formed on an image bearing body to form a visible image; a developer supply unit for supplying the developer to the developing unit; and a plurality of developer transporting units for transporting the developer in an axial direction. At least one of the developer transporting units transports the developer in a direction different from a direction that another developer transporting unit transports the developer.

20 Claims, 6 Drawing Sheets

| Distance between Outer Surfaces (mm) | Difference in Graininess Levels |
|---|---|
| 5 | ○ |
| 7. 5 | ○ |
| 10 | ○ |
| 12. 5 | △ |
| 15 | × |
| 17. 5 | × |
| 20 | × |
Fig. 6
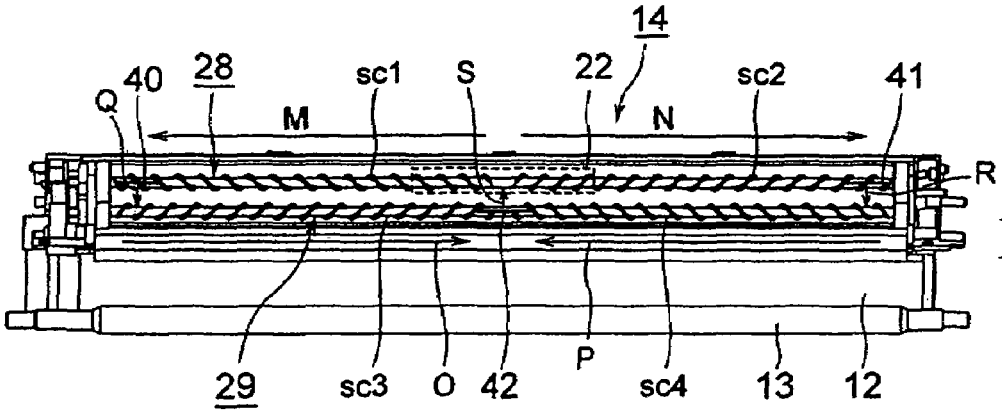
Fig. 7
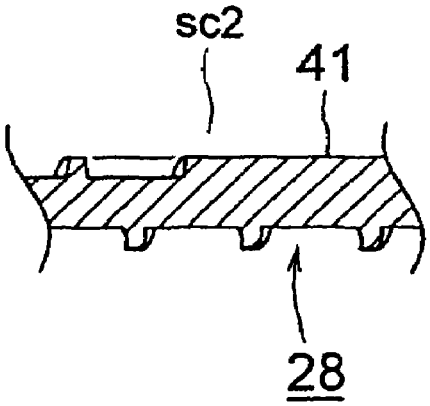
Fig. 8

| Distance L2 (mm) | Stability of Toner Transportation |
|---|---|
| 10 | ◎ |
| 20 | ○ |
| 30 | ○ |
| 40 | ○ |
| 50 | × |
| 60 | × |

DEVELOPING DEVICE HAVING DEVELOPER SUPPLY UNIT AND IMAGE FORMING APPARATUS

BACKGROUND OF THE INVENTION

The present invention relates to a developing device and an image forming apparatus having the developing device.

In a conventional image forming apparatus of an electric photography type such as a printer, a copier, and a facsimile, or a multifunctional product (NFP) having more than two such functions, a charging roller uniformly charges a surface of a photosensitive drum, and an exposure unit exposes the surface to form a static latent image thereon. A developing unit develops the static latent image to form a toner image. A transfer roller transfers the toner image to a sheet, and a fixing unit fixes the toner image to form an image, thereby printing the image on the sheet.

FIG. 2 is a view showing an essential part of a conventional printer. As shown in FIG. 2, the conventional printer includes an image forming unit 11; a photosensitive drum 12; a charging roller 13; and a developing device 14. The developing device 14 includes a developing roller 16; a developing blade 17; and a toner supply roller 18. The conventional printer also includes a cleaning unit 15; a developer storage space 20; a toner cartridge 21; and a toner supply port 22.

A stirring member 25 formed of a shaft with a crank shape is disposed in the developer storage space 20 above a contact portion between the developing roller 16 and the toner supply roller 18. The stirring member 25 stirs toner in the developer storage space 20 supplied from the toner cartridge 21 through the toner supply port 22. The stirring member 25 also prevents agglomerated toner or a foreign matter in toner from staying near the contact portion (refer to Japanese Patent Publication No. 2002-108089).

As described above, in the conventional printer, the stirring member 25 prevents agglomerated toner or a foreign matter in toner from staying near the contact portion. However, the stirring member 25 is not capable of transporting toner in an axial direction. Accordingly, over the time while toner in the developer storage space 20 is consumed and new toner is supplied, toner tends to accumulate at both sides of the developer storage space 20. In this state, when the printer performs printing, it is difficult to obtain good dot reproducibility and graininess at both sides of an image as opposed to a center thereof, thereby deteriorating image quality.

In view of the problems described above, an object of the present invention is to provide a developing device and an image forming apparatus for forming an image with improved image quality.

Further objects and advantages of the invention will be apparent from the following description of the invention.

SUMMARY OF THE INVENTION

In order to attain the objects described above, according to the present invention, a developing device comprises a developing unit for attaching developer to a latent image formed on an image bearing body to form a visible image; a developer supply unit for supplying the developer to the developing unit; and a plurality of developer transporting units for transporting the developer in an axial direction. At least one of the developer transporting units transports the developer in a direction different from a direction that another developer transporting unit transports the developer.

In the present invention, an image forming apparatus comprises the developing unit for attaching developer to a latent image formed on the image bearing body to form a visible image; the developer supply unit for supplying the developer to the developing unit; and a plurality of the developer transporting units for transporting the developer in an axial direction. At least one of the developer transporting units transports the developer in a direction different from a direction that another developer transporting unit transports the developer. Accordingly, it is possible to prevent the toner from staying at both sides of a developer storage space, thereby improving image quality.

BRIEF DESCRIPTION OF THE DRAWINGS

FIG. 6 is a table showing a relationship between a distance of an outer circumferential surface and a difference in graininess levels according to the first embodiment of the present invention;

FIG. 7 is a schematic plan view showing a developing device according to a second embodiment of the present invention;

FIG. 8 is a schematic enlarged view showing a developer transporting unit according to the second embodiment of the present invention;

DETAILED DESCRIPTION OF THE PREFERRED EMBODIMENTS

Hereunder, embodiments of the present invention will be explained with reference to the accompanying drawings. In the embodiment, a printer is used as an image forming apparatus of the invention for printing.

First Embodiment

Figure 1:
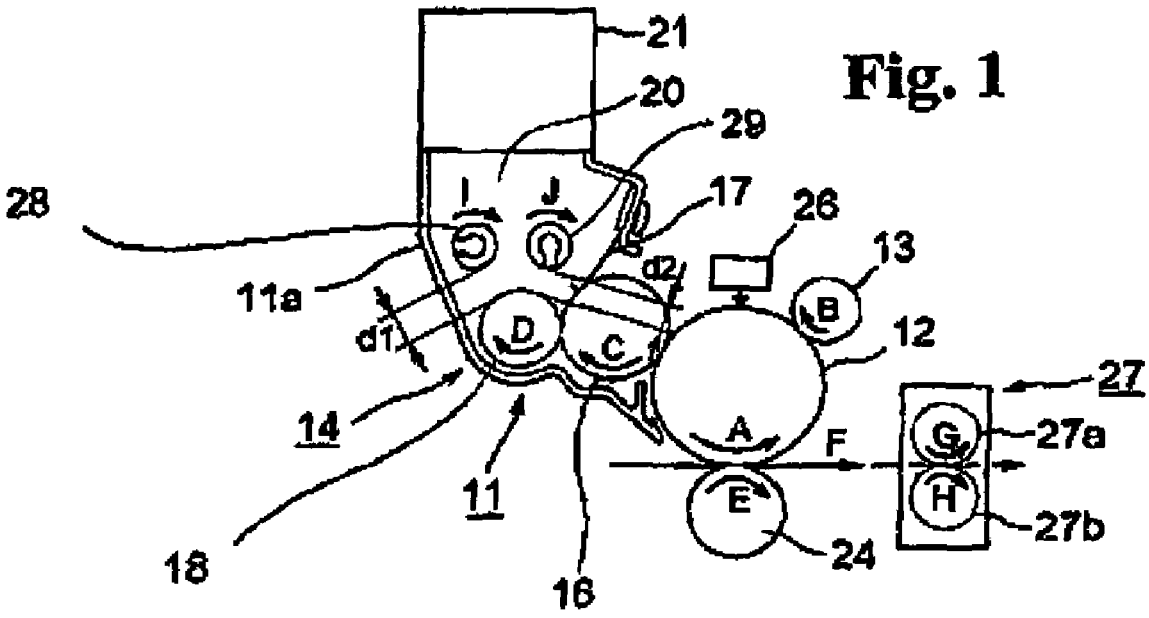
FIG. 1. is a schematic view showing an image forming apparatus according to a first embodiment of the present invention.
Figure 2:
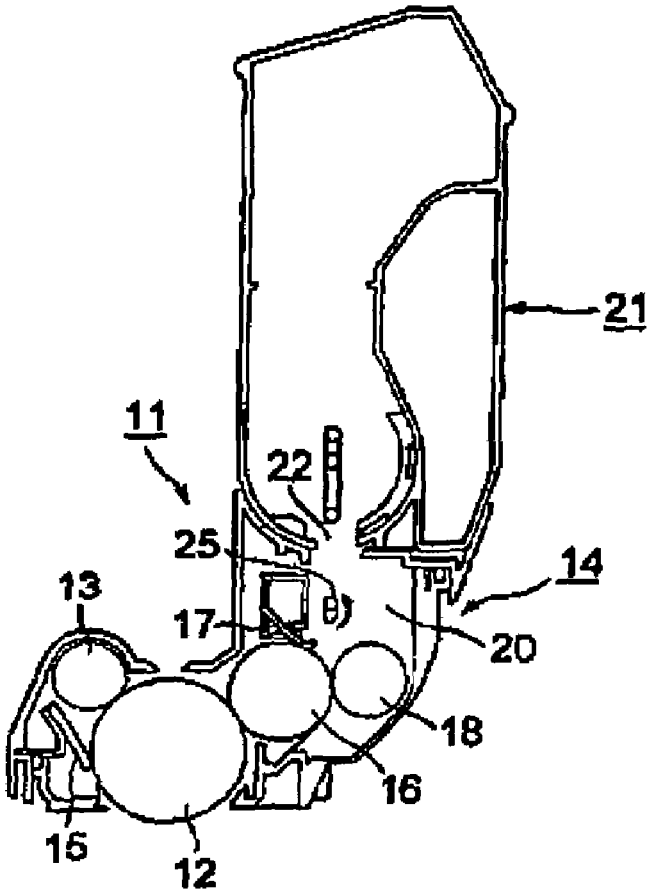
Fig. 2 Prior Art
FIG. 2 is a schematic view showing a conventional image forming apparatus.

FIG. 1 is a schematic view showing an image forming device according to a first embodiment of the present invention. As shown in FIG. 1, an image forming device includes an image forming unit 11; and a toner cartridge 21 detachably attached to a main body 11*a* of the image forming unit 11 for storing toner as developer and supplying the toner to a developer storage space 20 in the main body 11*a*. A photosensitive drum 12 is arranged in the main body 11*a* as an image bearing body to freely rotate in an arrow direction A. A charging roller 13 is arranged to freely rotate in an arrow direction B as a charging device, and uniformly charges a surface of the photosensitive drum 12 with negative polarity. An LED head 26 irradiates light corresponding to a printing pattern on the surface of the photosensitive drum 12, so that a static latent image is formed on the surface of the photosensitive drum 12.

As shown in FIG. 1, a developing device 14 includes a developing roller 16; a developing blade 17; a toner supply roller 18; and first and second developer transporting units 28 and 29. The developing roller 16 is arranged to face and contact with the photosensitive drum 12, and freely rotates in an arrow direction C. The developing blade 17 is arranged to abut against the developing roller 16. The toner supply roller 18 is arranged as a developer supply member to contact with the developing roller 16, and freely rotates in an arrow direction D. The first and second developer transporting units 28 and 29 are arranged to freely rotate in arrow directions I and J, respectively.

The developing blade 17 contacts with the developing roller 16 to charge toner to negative polarity through friction, so that a thin toner layer is formed on a surface of the developing roller 16. The developing roller 16 attaches the toner to the static latent image on the photosensitive drum 12 for development, thereby forming a toner image as a visible image.

Figure 3:
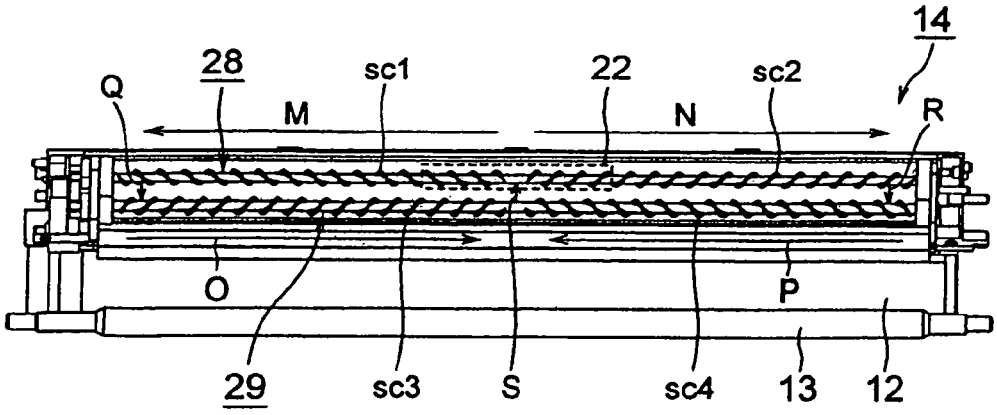
FIG. 3 is a schematic plan view showing a developing device according to the first embodiment of the present invention.
Figure 4:
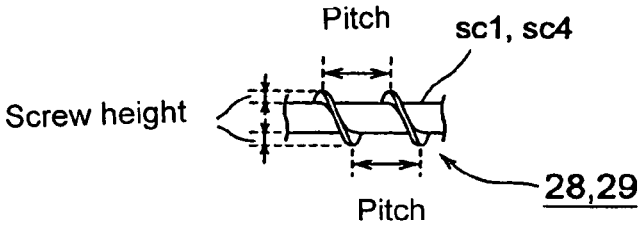
FIG. 4 is a schematic enlarged view showing a detailed portion of a developer transporting unit according to the first embodiment of the present invention.
Figure 5:
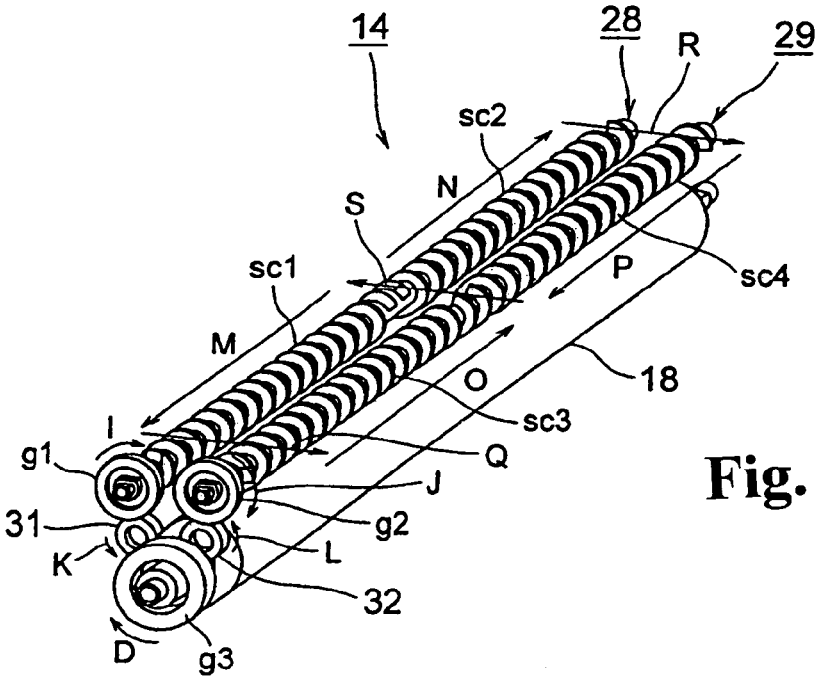
FIG. 5 is a schematic perspective view showing the developer transporting unit and a toner supply roller according to the first embodiment of the present invention.

A transfer roller 24 is disposed below the photosensitive drum 12 as a transfer device to rotate in an arrow direction E for transferring the toner image on the photosensitive drum 12 to a sheet moving in an arrow direction F as a printing medium. The transformer roller 24 applies a high voltage with positive polarity from a backside for attracting the toner having negative polarity on the photosensitive drum 12 to attach the toner to the sheet. After transferring the toner image, the sheet is transported to a fixing device 27 to melt and attach the toner to the sheet. The fixing device 27 includes a hear roller 27*a* arranged to freely rotate in an arrow direction G, and a pressure roller 27*b* arranged to freely rotate in an arrow direction H and urged toward the heat roller 27*a*. The printing is performed as described above. An outer surface of the toner supply roller 18 is apart from the outer surfaces of the first developer transporting unit 28 and the second developer transporting unit 29 by distances d1 and d2, respectively. The developing device 14 will be described next. FIG. 3 is a schematic plan view showing the developing in device 14 according to the first embodiment of the present invention. FIG. 4 is a schematic enlarged view showing a detailed portion of the first and second developer transporting units 28 and 29 according to the first embodiment of the present invention. FIG. 5 is a schematic perspective view showing the first and second developer transporting units 28 and 29 and the toner supply roller 18 according to the first embodiment of the present invention.

As shown in the figures, the first developer transporting unit 28 and the second developer transporting unit 29 are arranged at a same level, and are connected to the toner supply roller 18 through idle gears 31 and 32 arranged as rotation transmission members. The first and second developer transporting units 28 and 29 are provided with gears g1 and g2 at end portions thereof, and the toner supply roller 18 is provided with a gear g3 at an end portion thereof. The gears g1 and g2 engage the idle gears 31 and 32, and each of the idle gears 31 and 32 engages the gear g3. When the toner supply roller 18 rotates in the arrow direction D, the idle gears 31 and 32 rotate in the arrow directions K and L, respectively. Further, the first and second developer transporting units 28 and 29 rotate in the arrow directions I and J which is the same as the arrow direction D.

An operation of the developing device 14 will be described next. When new toner is supplied from the toner cartridge 21 to the developed storage space through a toner supply port 22, the first and second developer transporting units 28 and 29 stir the toner in the developer storage space 20. At this time, the first developer transporting unit 28 transports the toner from a center portion of the developer storage space 20 to both end sides thereof, that is, in the arrow directions M and N. The second developer transporting unit 29 transports the toner from the both end sides of the developer storage space 20 to the center portion thereof, that is, in arrow directions O and P.

Accordingly, the toner at both end portions of the first and second developer transporting units 28 and 29 is supplied from a side of the first developer transporting unit 28 toward the second developer transporting unit 29, that is, in arrow directions Q and R. At the same time, the toner at center portions of the first and second developer transporting units 28 and 29 is supplied from a side of the second developer transporting unit 29 toward the first developer transporting unit 28, that is, in an arrow direction S. In FIG. 3, reference numeral 12 denotes the photosensitive drum, and reference numeral 13 denotes the charging roller.

An experiment for evaluating graininess will be explained next. In the experiment, the first and second developer transporting units 28 and 29 integrally formed of an ABS resin have first to fourth screw sections sc1 to sc4 having a screw height of 2.0 mm and a pitch of 10.0 mm. In the experiment, the printing was performed while changing the distances d1 and d2 (FIG. 1) between the outer surfaces of the toner supply roller 18 and the first and second developer transporting units 28 and 29. FIG. 6 is a table showing a relationship between the distance between the outer surfaces and a difference in graininess levels at a center portion of an image and side portions thereof.

In the experiment, the printing was performed under a condition in which the toner is degraded most, that is, under a high temperature and a high humidity. A lateral band pattern was sequentially printed on 10,000 sheets with a 1% print duty. The level of the image was evaluated with a half-tone pattern sample having ten levels. When the difference in graininess levels between the center portion and the side portions was less than one, the result is represented by a circle. When the difference in graininess levels between the center portion and the side portions was two, the result is represented by a triangle. When the difference in graininess levels between the center portion and the side portions was more than three the result is represented by an X. In the ten level halftone pattern sample, an actual image was divided into specific areas with a standard deviation relative to a standard area of a dot, thereby evaluating the image.

In the experiment, it is found that when the distances d1 and d2 (FIG. 1) between the outer surfaces were less than 12.5 mm, the graininess levels between the center portion and the side portions became equal. Accordingly, it is preferable to set the distances d1 and d2 under 12.5 mm, more preferably under 10.0 mm. When the toner supply roller 18 contacted with the first and second developer transporting units 28 and 29, the first to fourth screw sections sc1 to sc4 left marks on the toner supply roller 18, thereby leaving similar marks on a sheet. Therefore, it is preferable to arrange the toner supply roller 18 not to contact the first and second developer transporting units 28 and 29.

As described above, in the embodiment, the first developer transporting unit 28 has the first and second screw selections sc1 and sc2 having screws winding in different directions with each other. Similarly, the second developer transporting unit 29 has the third and fourth screw sections sc3 and sc4 having screws winding in different directions with each other. The first to fourth screw sections sc1 to sc4 rotate in a same direction. The first and second developer transporting units 28 and 29 stir the toner in the developer storage space 20 and new toner supplied through the toner supply port 22. At this time, the first developer transporting unit 28 transports the toner from the center portion of the developer storage space 20 to the end sides thereof, and the second developer transporting unit 29 transports the toner from the end sides of the developer storage space 20 to the center portion thereof. Accordingly, degrades toner does not stay at the end sides of the developer storage space 20, thereby preventing graininess at side portions of an image from deteriorating and improving image quality.

Second Embodiment

The second embodiment of the present invention will be explained next. Components the same as those in the first embodiment are designated by the same reference numerals, and explanations thereof are omitted.

FIG. 7 is a schematic plan view showing a developing device according to the second embodiment of the present invention. FIG. 8 is a schematic enlarged view showing a developer transporting unit according to the second embodiment of the present invention. As shown in the figures, the first developer transporting unit 28 is provided with ribs 40 and 41 at both end portions thereof, and the second developer transporting unit 29 is provided with a rib 42 at a center portion thereof. Each of the ribs 40 to 42 extends along an axial direction over specific pitches (two pitches in the present embodiment), and has a height the same as that of the screw height of each screw.

When the first developer transporting unit 28 transports the toner in the developer storage space 20 from the center portion thereof toward the both end sides, the ribs 40 and 41 strongly push the toner in arrow directions Q and R. When the second developer transporting unit 29 transports the toner in the developer storage space 20 from the both end sides thereof toward the center portion, the rib 42 strongly pushes the toner in an arrow direction S. Accordingly, in the second embodiment, it is possible to strongly push the toner between the first and second developer transporting units 28 and 29, thereby preventing the toner from staying and making it possible to stably transport the toner.

Third Embodiment

In the second embodiment, the third and fourth screw sections sc3 and sc4 have a length the same as that of the first and second screw sections sc1 and sc2. Further, the second developer transporting unit 29 is provided with the rib 42 at the center portion thereof. Accordingly, at the center portion of the second developer transporting unit 29, the toner is supplied from the second developer transporting unit 29 to the first developer transporting unit 28 by a quantity larger than that of the toner supplied from the center portion of the first developer transporting unit 28 to the end portions thereof. As a result, the toner tends to stay at the center portion of the first developer transporting unit 28. In the third embodiment, the first developer transporting unit 28 is arranged to prevent the toner from staying at the center portion of the first developer transporting unit 28. Components the same as those in the first embodiment are designated by the same reference numerals, and explanations thereof are omitted.

Figures 9, 10:
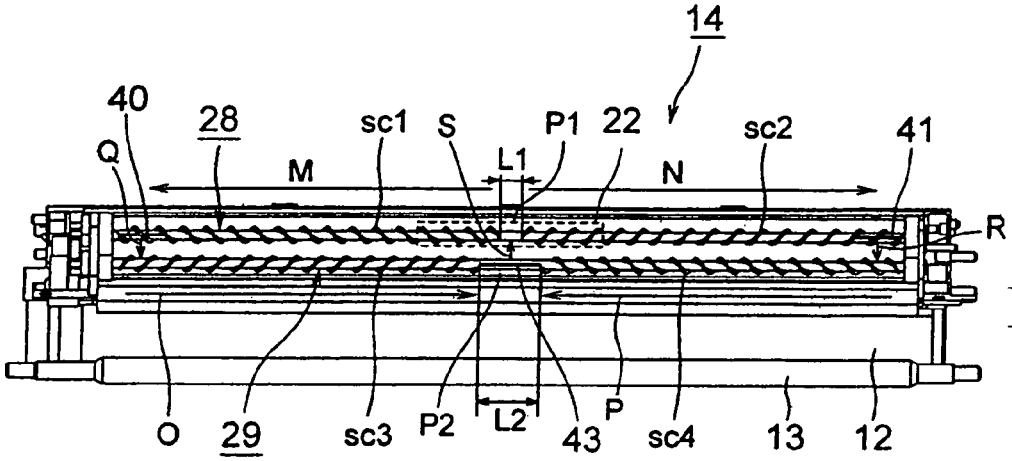
FIG. 9 is a schematic plan view showing a developing device according to a third embodiment of the present invention.
FIG. 10 is a table showing a relationship between a distance representing a length of a rib and a degree of stability in toner transportation according to the third embodiment of the present invention.

FIG. 9 is a schematic plan view showing a developing device 14 according to the third embodiment of the present invention. In the third embodiment, the first developer transporting unit 28 is provided with a no-screw portion 21 between the first and second screw sections sc1 and sc2, and the second developer transporting unit 29 is provided with a no-screw portion P2 between the third and fourth screw sections sc3 and sc4. The first screw section sc1 is apart from the second screw sections sc2 by a distance L1, and the third screw section sc3 is apart from the fourth screw section sc4 by a distance L2, so that the distance L1 becomes smaller than the distance L2. Further, the second developer transporting unit 29 is provided with a rib 43 at the noscrew portion P2. The rib 43 extends in the axial direction, and has a height the same as the screw height.

When the second developer transporting unit 29 transports the toner in the developer storage space 20 from the both end sides thereof toward the center portion, the rib 43 strongly pushes the toner in the arrow direction S. Th the first developer transporting unit 28, the first and second screw sections sc1 an sc2 arranged apart by the distance L1 shorter than the distance L2 transport the toner in the developer storage space 20 from the center portion thereof toward the both end sides, and ribs 40 and 41 strongly push the toner in the arrow directions O and R.

An experiment for evaluating toner transportation performance of the developing device 14 will be explained next. In the experiment, the toner was filled in the developer storage space 20 up to a height just over the first and second developer transporting units 28 and 29. FIG. 10 is a table showing a relationship between a distance representing a length of the rib 43 and a degree of stability in the toner transportation according to the third embodiment of the present invention. In the table, a circle represents good performance, and X represents poor performance. In the experiment, the second developer transporting unit 29 had the distance L2, i.e., the length of the rib 43, between 10.0 and 60.0 mm. The distance L1 of the first developer transporting unit 28 was shorter than the distance L2 by 20.0 mm (L1 = L2 − 20). When the distance L2 was less than 20.0 mm, the distance L1 was set at 5.0 mm.

As shown in FIG. 10, when the distance L2 was between 10.0 and 40.0 mm, the toner was stably transported. When the distance L2 was greater than 50.0 mm, the third and fourth screw sections sc3 and sc4 did not provide sufficient transportation force to the center portion. Accordingly, the toner tended to stay at the center portion, thereby making it difficult to stably transport the toner. As a result, it is preferred that the distance is set less than 40.0 mm, more preferably between 20.0 and 40.0 mm, to stably transport the toner at the center portion of the developer storage space 20.

As described above, in the embodiment, the distance L1 is set to be shorter than the distance L2, and the distance L2 is set to be less than 40.0 mm. Accordingly, the first and second screw sections sc1 and sc2 can effectively transport the toner pushed by the rib 43 in the arrow direction S, thereby making it possible to stably transport the toner at the center portion of the developer storage space 20.

Fourth Embodiment

The fourth embodiment of the present invention will be explained next. Components the same as those in the first to third embodiments are designated by the same reference numerals, and explanations thereof are omitted.

Figure 11:
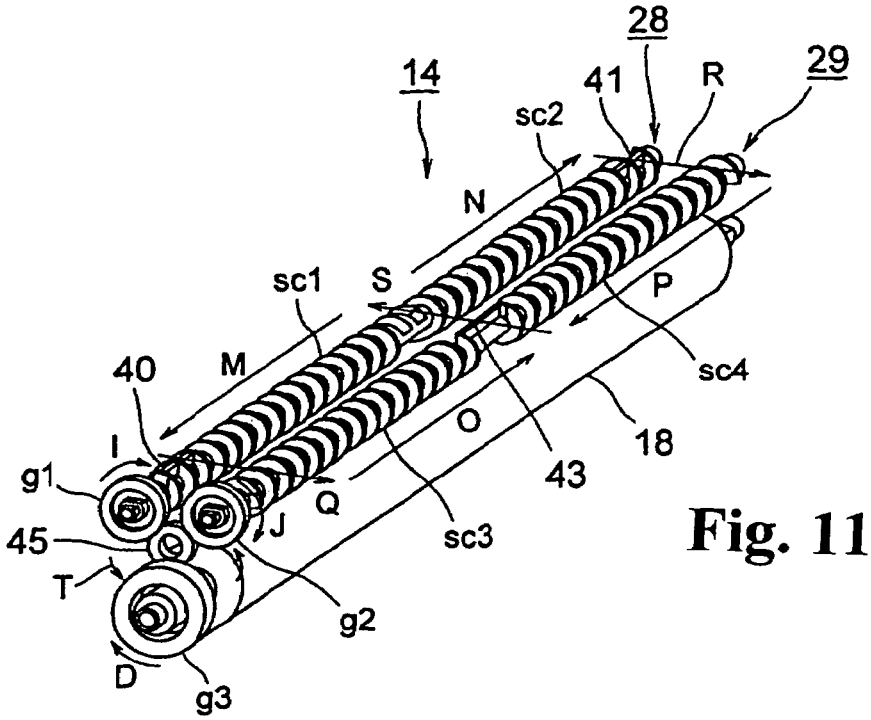
FIG. 11 is a schematic perspective view showing a developer transporting unit and a toner supply roller according to a fourth embodiment of the present invention.

FIG. 11 is a schematic perspective view showing first and second developer transporting units 28 and 29 and a toner supply roller 18 according to the fourth embodiment of the present invention. In the embodiment, the first and second developer transporting units 28 and 29 are connected to the toner supply roller 18, i.e., a developer transporting member, through an idle gear 45 having an arbitrary length, that is an arbitrary number of teeth, as a rotation transmission member.

In the embodiment, the first and second developer transporting units 28 and 29 are arranged at a same level, and are connected to the toner supply roller 18 through the idle gear 45, respectively. The first and second developer transporting units 28 and 29 are provided with gears g1 and g2 at end portions thereof, and the toner supply roller 18 is provided with a gear g3 at an end portion thereof. The gears g1 and g2 engage the idle gear 45, and the idle gear 45 engages the gear g3. When the toner supply roller 18 rotates in the arrow direction D, the idle gear 45 rotates in an arrow direction T. Further, the first and second developer transporting units 28 and 29 rotate in the arrow direction I and J which is the same as the arrow direction D.

In the embodiment, the first and second developer transporting units 28 and 29 are connected to the toner supply roller 18 through the idle gear 45. Accordingly, it is possible to easily change a positional relationship between the first and second developer transporting units 28 and 29 and the toner supply roller 18 according to a size of the idle gear 45. It is also possible to maintain the first and second developer transporting units 28 and 29 with a constant distance in between, thereby effectively stirring and transporting the toner near the toner supply roller 18. Further, since the first and second developer transporting units 28 and 29 are connected to the toner supply roller 18 through the common idle gear 45, it is possible to reduce the number of parts.

Figure 12:
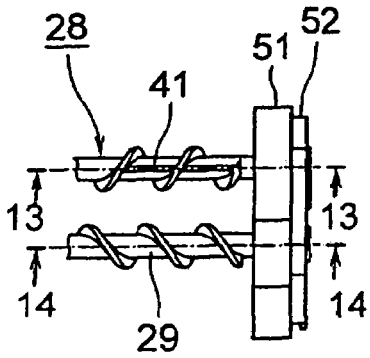
FIG. 12 is a schematic perspective view showing an end portion of the developer transporting unit according to the fourth embodiment of the present invention.
Figure 13:
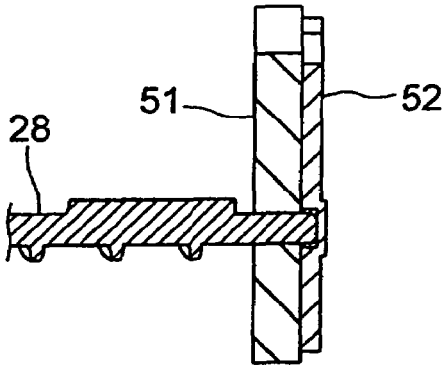
FIG. 13 is a sectional view taken along a line 13-13 in FIG. 12.
Figure 14:
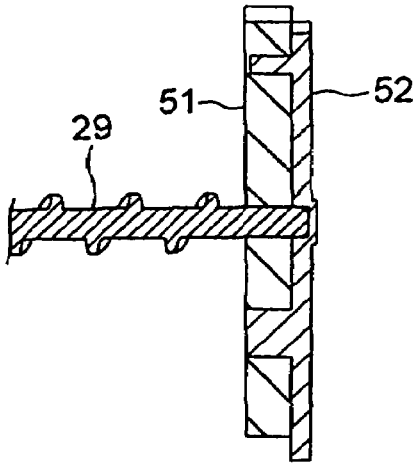
FIG. 14 is a sectional view taken along a line 14-14 in FIG. 12.

In the fourth embodiment, the first and second developer transporting units 28 and 29 are provided with a sealing member 51 at the end portions thereof for preventing the toner from leaking and a plate member 52 for supporting rotational shafts of the first and second developer transporting units 28 and 29. FIG. 12 is a schematic perspective view showing the end portions of the first and second developer transporting units 28 and 29 according to the fourth embodiment of the present invention. FIG. 13 is a sectional view taken along a line 13-13 in FIG. 12. FIG. 14 is a sectional view taken along a line 14-14 in FIG. 12.

As shown in the figures, the first and second developer transporting units 28 and 29 are provided with the sealing member 51 at the end portions thereof for preventing the toner from leaking and the plate member 52 for supporting the rotational shafts of the first and second developer transporting units 28 and 29.

Fifth Embodiment

In the fourth embodiment, the rotational shafts of the first and second developer transporting units 28 and 29 have a same diameter. Accordingly, it is possible that two same developer transporting units might be mistakenly assembled in the developing device 14. In this case, the toner is transported in one direction, and there is not sufficient toner at an upstream side of the transportation, thereby causing a thin print and deteriorating image quality.

Figure 15:
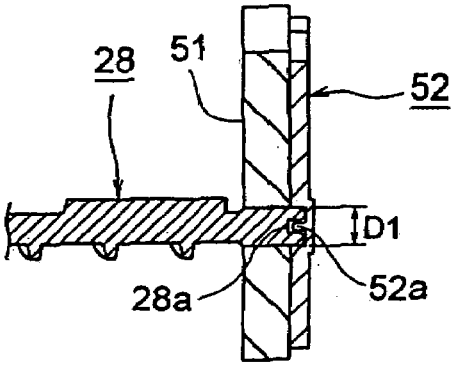
FIG. 15 is a sectional view showing a first developer transporting unit according to a fifth embodiment of the present invention.
Figure 16:
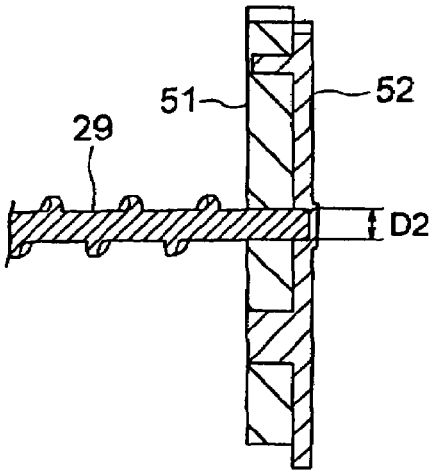
FIG. 16 is a sectional view showing a second developer transporting unit according to the fifth embodiment of the present invention.

In the fifth embodiment, it is possible to prevent two same developer transporting units from being mistakenly assembled in the developing device 14. FIG. 15 is a sectional view showing an end portion of a first developer transporting unit 28 according to the fifth embodiment of the present invention. FIG. 16 is a sectional view showing an end portion of a second developer transporting unit 29 according to the fifth embodiment of the present invention.

In the embodiment, a rotational shaft of the first developer transporting unit 28 has a diameter of D1, and a rotational shaft of the second developer transporting unit 29 has a diameter of D2. It is arranged such that the diameter D1 becomes greater than the diameter D2. Further, the first developer transporting unit 28 is provided with a recess portion 28*a* at an end portion of the rotational shaft, and the plate member 52 is provided with a protrusion 52*a* at a bearing portion thereof corresponding to the recess portion 28*a*. Reference numeral 51 denotes the sealing member.

Since the diameter D1 is greater than the diameter D2, the first developer transporting unit 28 is not inserted into a side of the second developer transporting unit 29. Since the protrusion 52*a* abuts against the end portion of the rotational shaft of the first developer transporting unit 28, the second developer transporting unit 29 is not inserted into a side of the first developer transporting unit 28.

As described above, the first and second developer transporting units 28 And 29 have the rotational shafts with different shapes of the end portions. Accordingly, it is possible to prevent the first and second developer transporting units 28 and 29 from being mistakenly assembled in the developing device 14. Therefore, the toner is not transported in one direction, and there is sufficient toner at an upstream side of the transportation, thereby preventing a thin print and improving image quality.

In the embodiments described above, the toner is formed of one component as the developer, and the toner may be formed of more than two components.

The disclosure of Japanese Patent Application No. 2004 225469, filed on Aug. 2, 2004, is incorporated in the application.

While the invention has been explained with reference to the specific embodiments of the invention, the explanation is illustrative and the invention is limited only by the appended claims.

What is claimed is:

1. A developing device comprising:

a developing unit for attaching developer to a latent image formed on an image bearing body to form a visible image;

a developer supply unit for supplying the developer to the developing unit; and a plurality of developer transporting units for transporting the developer in an axial direction, at least one of said plurality of developer transporting units transporting the developer in a direction different from a direction that another developer transporting unit transports the developer, each of said developer transporting units including first and second screw sections having a first screw and a second screw, respectively, said first screw having a pitch substantially same as that of the second screw, said first screw having a screw height substantially same as that of the second screw, said first screw having a length substantially same as that of the second screw, said first screw winding in a direction different from a direction that the second screw winds.

2. The developing device according to claim 1, wherein each of said plurality of developer transporting units rotates in a direction same as the direction that the developer supply unit rotates.

3. The developing device according to claim 1, wherein said developer supply unit includes an outer surface situated away from an outer surface of at least one of the plurality of developer transporting units by a distance from 0 to 12.5 mm.

4. The developing device according to claim 1, wherein at least one of said plurality of developer transporting units includes first ribs at both end portions thereof having a height the same as the screw height, said developer supply unit including a second rib at a center portion thereof having a height the same as that of the screw section.

5. The developing device according to claim 1, wherein at least one of said plurality of developer transporting units includes a first space at a middle thereof between the first screw section and the second screw section, another one of said plurality of developer transporting units including a second space at a middle thereof between the first screw section and the second screw section, said first space having a first distance and said second space having a second distance such that the first distance is smaller than the second distance and the second distance is equal to or smaller than 40.0 mm.

6. The developing device according to claim 5, wherein said another one of said plurality of developer transporting units includes a rib in the second space having a height substantially the same as the screw height.

7. The developing device according to claim 1, further comprising a rotation transmission member so that the plurality of developer transporting units are connected to the developer supply unit through the rotation transmission member.

8. The developing device according to claim 1, wherein each of said plurality of developer transporting units includes a rotational shaft having an end portion with a shape different from each other.

9. An image forming apparatus comprising the developing device according to claim 1.

10. A developing device comprising:

a developing unit disposed along a short side direction for attaching developer to a latent image formed on an image bearing body to form a visible image;

a developer supply unit disposed along the short side direction for supplying the developer to the developing unit; and a plurality of developer transporting units disposed substantially along the short side direction for transporting the developer in an axial direction along a long side direction, said developer transporting units including a first developer transporting unit for transporting the developer along the axial direction from both end portions thereof toward a center portion thereof and a second developer transporting unit disposed adjacent to the first developer transporting unit along a direction perpendicular to the axial direction for transporting the developer along the axial direction from a center portion thereof toward both end portions thereof.

11. The developing device according to claim 10, wherein each of said developer transporting units includes a screw section for transporting the developer.

12. The developing device according to claim 11, wherein at least one of said developer transporting units includes first ribs at both end portions thereof having a height same as the screw height, said developer supply unit including a second rib at a center portion thereof having a height same as that of the screw section.

13. The developing device according to claim 10, wherein each of said developer transporting units rotates in a direction same as a direction that the developer supply unit rotates.

14. The developing device according to claim 10, wherein each of said developer transporting units includes first and second screw sections having a first screw and a second screw, respectively, said first screw having a pitch substantially same as that of the second screw, said first screw having a screw height substantially same as that of the second screw, said first screw having a length substantially same as that of the second screw, said first screw winding in a direction different from a direction that the second screw winds.

15. The developing device according to claim 14, wherein at least one of said developer transporting units includes a first space at a middle thereof between the first screw section and the second screw section, another one of said developer transporting units including a second space at a middle thereof between the first screw section and the second screw section, said first space having a first distance and said second space having a second distance such that the first distance is smaller than the second distance and the second distance is equal to or smaller than 40.0 mm.

16. The developing device according to claim 10, wherein said another one of said developer transporting units includes a rib in the second space having a height substantially same as the screw height.

17. The developing device according to claim 10, wherein said developer supply unit includes an outer surface situated away from an outer surface of at least one of the developer transporting units by a distance from 0 to 12.5 mm.

18. The developing device according to claim 10, further comprising a rotation transmission member so that the developer transporting units are connected to the developer supply unit through the rotation transmission member.

19. The developing device according to claim 10, wherein each of said developer transporting units includes a rotational shaft having an end portion with a shape different from each other.

20. An image forming apparatus comprising the developing device according to claim 10.

* * * * *